US005528993A

United States Patent [19]

Vincelli

[11] Patent Number: 5,528,993

[45] Date of Patent: Jun. 25, 1996

[54] FOLDING BALCONY

[75] Inventor: Richard F. Vincelli, Saint-Lazare, Canada

[73] Assignee: Vincos Balcony Table Inc./Table De Balcon Vincos Inc., Montreal, Canada

[21] Appl. No.: 517,652

[22] Filed: Aug. 22, 1995

Related U.S. Application Data

[63] Continuation of Ser. No. 114,760, Aug. 18, 1993, abandoned.

[51] Int. Cl.[6] ..... A47B 5/00

[52] U.S. Cl. ..... 108/48; 108/42

[58] Field of Search ..... 108/48, 40, 42, 108/44, 35, 47, 34

[56] References Cited

U.S. PATENT DOCUMENTS

| | | | |
|---|---|---|---|
| 1,331,635 | 2/1920 | Flaherty | 108/48 |
| 1,553,821 | 9/1925 | Johnson | 108/40 X |
| 2,814,892 | 12/1957 | Larsen | 108/48 |
| 2,833,608 | 5/1958 | Tobias | 108/48 X |
| 3,344,755 | 10/1967 | Gover | 108/40 |
| 4,263,854 | 4/1981 | Moore et al. | 108/40 X |
| 4,803,930 | 2/1989 | Cresoli | 108/48 |
| 4,889,057 | 12/1989 | Chartrand | 108/42 |
| 4,909,158 | 3/1990 | Sorenson | 108/42 X |
| 5,040,467 | 8/1991 | King | 108/42 |

FOREIGN PATENT DOCUMENTS

| | | | |
|---|---|---|---|
| 06615 | 4/1992 | WIPO | 108/48 |

*Primary Examiner*—José V. Chen

[57] ABSTRACT

A balcony table movable between a vertical, storage position and a horizontal, operative position. The table has a base and a table top. The base is adapted to be mounted on the balcony railing and has a first support from which the table hangs in the storage position. The base also has a second, separate support to support the table top in its operative position. The table top is movable both vertically and horizontally relative to base when moving between both positions. The horizontal component of movement allows the table top to be mounted flush against the railing. The table can include a support leg that is mounted on the side of the table top when not in use.

20 Claims, 4 Drawing Sheets

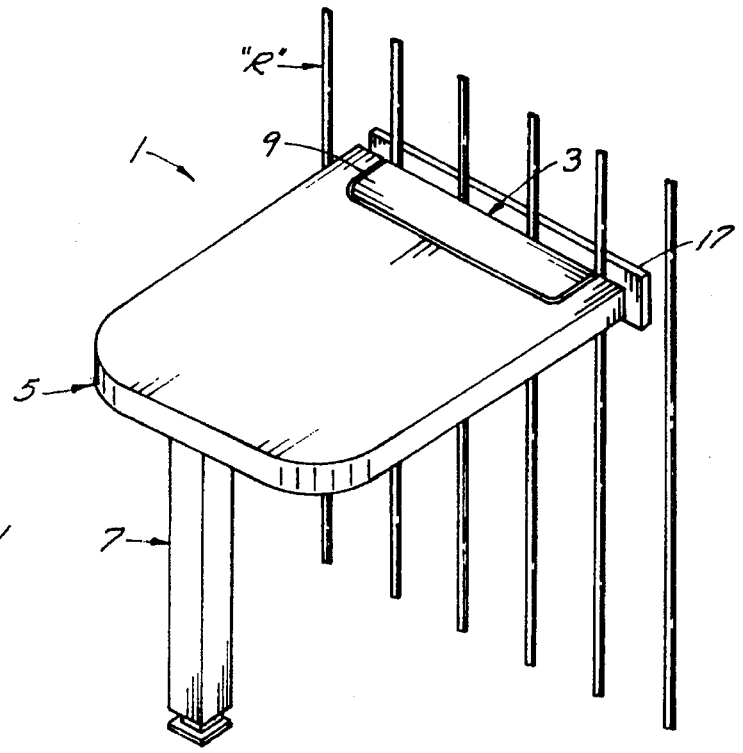
FIG. 1
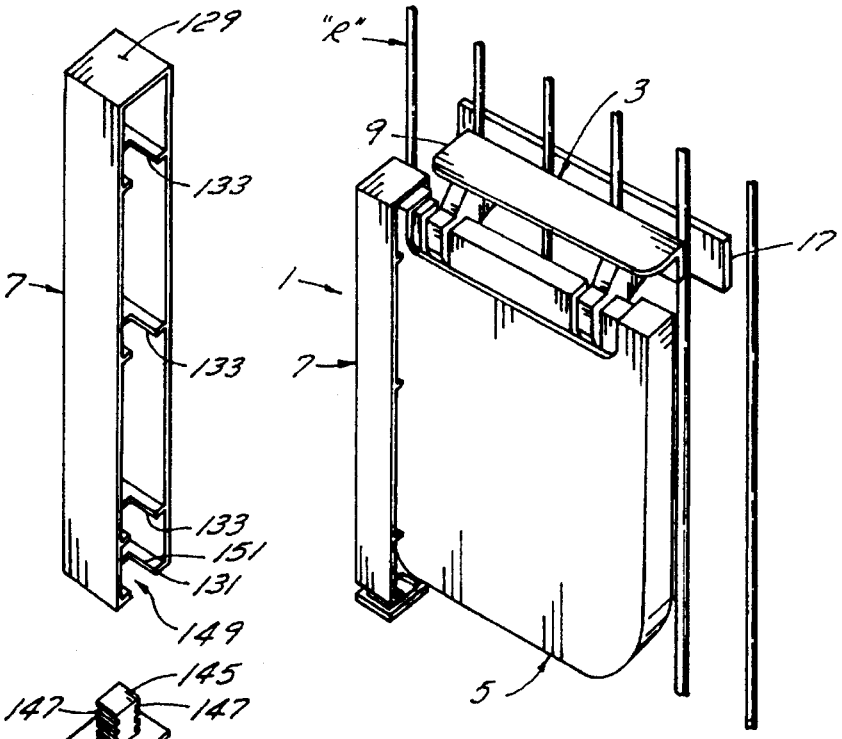
FIG. 2
FIG. 11

FOLDING BALCONY

This application is a continuation of application Ser. No. 08/114,760, filed Aug. 18, 1993, now abandoned.

BACKGROUND OF THE INVENTION

1. Field of the Invention

This invention is directed toward a table adapted to be mounted on a vertical support such as a wall. More particularly, the invention is directed toward a table adapted to be mounted on a balcony railing.

2. Description of the Prior Art

Wall mounted tables that are movable between a stored, vertical position adjacent the wall, and a horizontal, operative position extending out from the wall, are known. These known tables are handy since they provide a table surface in a cramped area when needed, and then can be easily moved to an out-of-the-way position, when not needed.

These known tables normally employ hinges allowing them to move between operative and stored positions. The hinges however make the tables relatively expensive because of the cost of mounting the hinges and because of the extra parts involved. The known tables also often employ brackets to support the table in its operative position adding to the cost, particularly when the brackets are foldable. The tables also usually employ legs. The legs also are usually hinged to the table adding to the cost. In addition, storage of the legs is often awkward. The known tables often leave a space between the table top and the wall when in the operative position. This makes for inefficient use of the available space.

SUMMARY OF THE INVENTION

It is the purpose of the present invention to provide an improved, vertical-support, mounted table that employs a minimum of parts. It is another purpose of the present invention to provide an improved table that can be easily moved between operative and stored positions without the use of hinges and which does not require braces. It is a further purpose of the present invention to provide an improved table that employs a support leg which is easily deployed and neatly stored when not needed, and which does not require hinges. It is yet a further purpose of the present invention to provide a vertical-support mounted table having a neat, clean appearance in the operative position with a large unbroken surface area and with no gap between the vertical support and the table top.

In accordance with the present invention there is provided a table having a base and a table top. The base is mounted on a vertical support surface and the table top is supported from the base. First support means in the form of hangers on the table top loosely support the table top from support arms on the base in a vertical, storage position. Separate, second support means on the base and table top support the table top from the base in a horizontal, operative position. The table top is movable both vertically and horizontally relative to the base to have the table top cooperate with the first or with the second support means on the base depending on the position desired. The relative horizontal movement allows the table top to be mounted flush against the support surface in its operative position. The table has a neat, clean appearance when set up, with a smooth unbroken top surface extending from the wall.

The second support means can support the table top in cantilevered fashion. However a support leg for the table can be provided that is easily mounted on the side of the table when not needed, and removable and easily set up when needed.

The invention is particularly directed toward a table having a relatively narrow base and a relatively wide table top. The base has mounting means for use in mounting the table against a vertical support. First cooperating support means on the base and on one end of the table top vertically suspend the table top from the base in a storage position. Second, separate cooperating support means on the base and on the one end of the table top horizontally support the table top in a horizontal, operative position on the base.

BRIEF DESCRIPTION OF THE DRAWINGS

FIG. 1 is a perspective view of the table in its horizontal, operative position;

FIG. 2 is a perspective view of the table in its vertical, stored position;

FIG. 11, appearing on the same sheet as FIG. 1, is a perspective, exploded view of the table leg.

DESCRIPTION OF THE PREFERRED EMBODIMENTS

Figure 3:
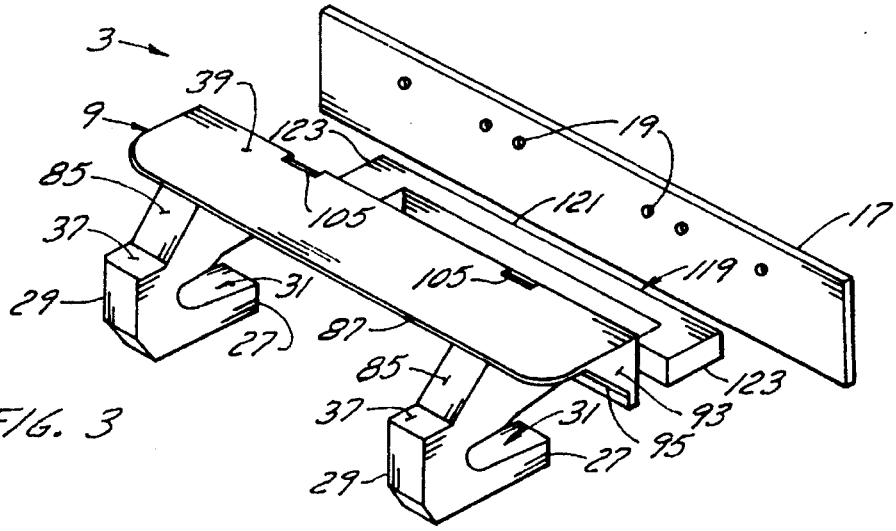
FIG. 3 is a front perspective view of the base.
Figure 4:
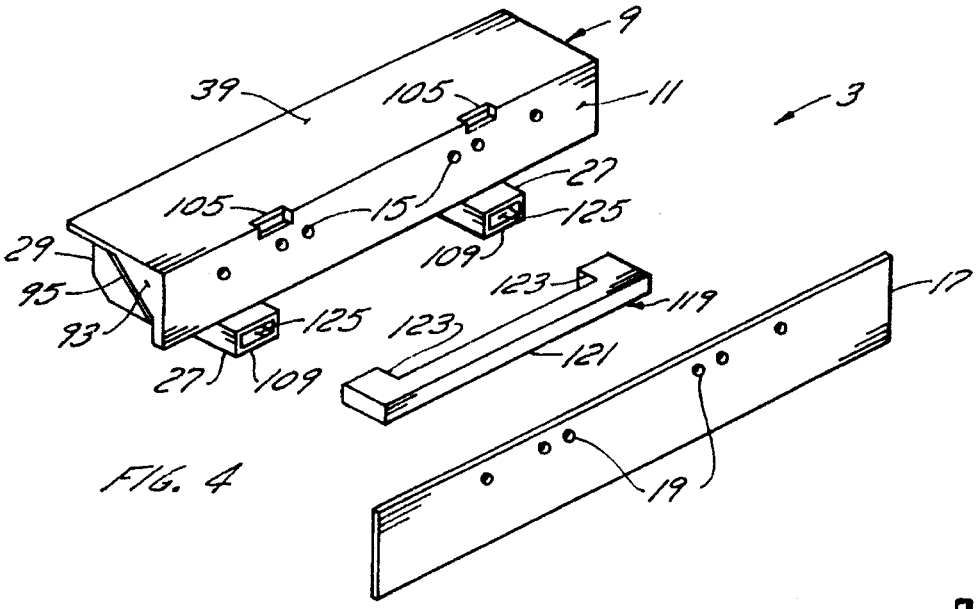
FIG. 4 is a rear perspective view of the base.
Figure 5:
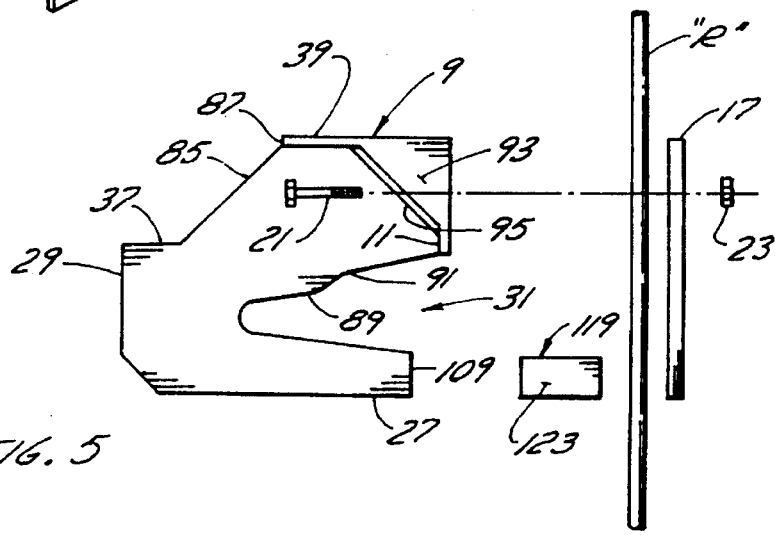
FIG. 5 is a side view of the base mounted on a balcony railing.

The table 1 of the present invention, as shown in FIGS. 1 and 2 has a base 3 and a table top 5. The table can also have at least one support leg 7 if desired. The base 3 is relatively narrow as compared to the length of the table top 5 and is adapted to be fastened to a vertical support such as a wall or railing. The base 3 has a mounting member 9 as shown in FIGS. 3 to 5. The mounting member 9 has a back plate 11. Through holes 15 are provided in the back plate 11 through which bolts can pass to mount the mounting member 9 tight against the vertical support. The mounting member 9 can be mounted flush against a vertical wall, such as a building wall, with the bolts entering the wall. Preferably however the table is designed to be mounted against a balcony railing "R". To this end the base 3 is provided with a backing member 17. The backing member 17 is in the form of a plate and has through holes 19 that are aligned with the holes 15 in the back plate 11 of the mounting member 9. When the mounting member 9 is mounted tight against the inner side of a balcony railing "R", the backing member 17 is mounted opposite it on the outer side of the railing and bolts 21 can be passed through the aligned holes 15 and 19 in the back plate 11 and the backing member 17 respectively. Nuts 23 are threaded onto the bolts 21 and tightened to clamp the mounting member 9 and the backing member 17 tight against the railing "R" located in between them.

The base 3 has first support means on the mounting member 9 for use in supporting the table top 5 from the base 3 in a vertical, stored position when the base 3 is mounted to a vertical support. The first support means comprise a pair of spaced-apart arms 27 that are generally horizontal when the base 3 is mounted to the vertical support. The arms 27 are located beneath and forwardly of the back plate 11 and are each attached to the back plate 11 by a brace 29 that extends from the front end of the arm 27 to the back plate 11. The braces 29 angle upwardly and rearwardly and, together with the arms 27, define rearward opening slots 31. The mouth of the slots 31 are located just beneath the back plate 11.

The base 3 also has second support means on the mounting member 9 for use in supporting the table top 5 on the base 3 in a horizontal, operative position when the base 3 is mounted on the vertical support. The second support means preferably includes a pair of spaced-apart abutment surfaces 37 that are horizontal when the base 3 is mounted in place. The abutment surfaces 37 are located slightly in front of, and slightly above the arms 27. The abutment surfaces 37 are preferably formed in the front portion of the braces 29. The second support means also includes a top plate 39 on the mounting member 9. The top plate 39 is located rearwardly and upwardly from the abutment surfaces 37 and is parallel to them. The top plate 39 is attached to the top of the back plate 11 and extends forwardly at right angles to it. The braces 29 are also attached to the bottom of the top plate 39.

The table top 5, as shown in FIGS. 6 to 9, is quite long compared to the length of the top plate 39 of the base 3 and is slightly wider than the top plate 39. The table top 5 is generally square in shape. The table top 5 is defined by a top sheet 45 and a narrow skirt 47 joined to the top sheet 45 about its periphery and extending at right angles to it. Reinforcing ribs 49 on the underside of the top sheet 45 criss-cross within the skirt 47 between the front and back 51, 53 and between the sides 55 of the table top 5 to reinforce and stiffen it. The top sheet 45 has a shallow depression 57 adjacent the back 53 of the table top 5 sized to snugly receive the top plate 39 of the base 3 as will be described. The skirt 47 also is recessed at the back 53 of the table top 5 as shown by recess 59 to receive the back plate 11 of the base 3.

First support means are provided on the table top 5 for cooperating with the first support means on the base 3 to support the table top vertically from the base 3. The first table top support means comprise a pair of spaced-apart hangers 61 located at the back 53 of the table top 5. Each hanger 61 can comprise a rod 63 mounted between two brackets 65, 67. The brackets 65, 67 extend down from the top sheet 45 and the back of the skirt 47. The two rods 63 are aligned, extending parallel to the top sheet 45 and are located just below the skirt 47.

Second support means are provided on the table top 5 for cooperating with the second support means on the base 3 to support the table top in a horizontal, operative position. The second table top support means includes a pair of spaced-apart stop surfaces 73 on the bottom of the table top 5 spaced forwardly of the hangers 61. The stop surfaces 73 preferably form portions of the bottom edge of one of the reinforcing ribs 49A that extends across the table top 5 parallel to the back 53 of the table top 5. The location of the stop surfaces 73 is shown by the brackets 75 in FIG. 7. The second support means on the table top 5 also includes the depressed portion 57 of the top sheet 45.

The table top 5 has a pair of slot openings 81 in the shallow depression 57. The openings 81 extend rearwardly from the front edge 83 of the depression 57 to the back 53 of the table top. Each opening 81 is located between a pair of the brackets 65, 67 defining the hangers 61. The braces 29 and attached arms 27 on the base 3 pass through the openings 81 when the table top 5 is mounted on the base 3 as will be described.

The table 1 is provided with guide means for guiding the table top 5 relative to the base 3 during movement of the table top relative to the base from a stored to an operative position. The guide means, as shown in FIGS. 3 and 5, can comprise a cam surface 85 formed on the front side of each brace 29 and extending upwardly and rearwardly from the horizontal abutment surface 37 to the front edge 87 of the top plate 39. The top wall 89 of the slots 31 is relieved upwardly and to the rear as shown at 91 to provide clearance for the hanger rods 63 as will be described.

Figure 6:
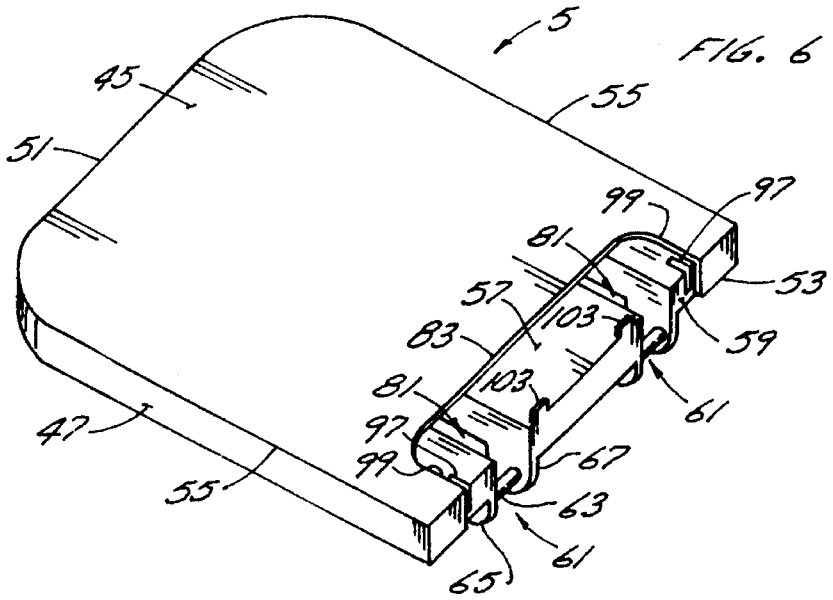
FIG. 6 is a perspective view of the table top.

The table 1 can also be provided with locating means for locating the table top 5 in a precise lateral position relative to the base 3 so that the back and top plates 11, 39 of the base will seat properly in the recess and depression 59, 57 respectively in the table top 5 when the table top 5 is being moved to its operative position. The locating means can comprise a triangular rib 93 at each end of the base 3 extending between the top and back plates 39, 11 and perpendicular to them as shown in FIGS. 3 to 5. The edge 95 of each rib 93 is tapered. The table top 5 is provided with a slot 97 adjacent each end 99 of the depression 57 as shown in FIG. 6. The slots 97 extend perpendicular to the top sheet 45 and open both into the depression 57 and the recess 59. As the table top 5 is being moved to its operative position, the ribs 93 snugly enter the slots 97 to laterally align the table top 5 with the base 3.

Retaining means are provided on the table for retaining the table top 5 in its operative horizontal position. The retaining means can comprise a pair of spaced-apart tabs 103 extending upwardly from the skirt 47 at the back 53 of the table top as shown in FIG. 6. One tab 103 is located adjacent the inner side of each hanger 61. The tabs 103 are no higher than the top sheet 45 of the table top 5. The retaining means also includes a pair of openings 105 in the base 3 for receiving the tabs 103 as shown in FIGS. 3 and 4. The openings 105 are located in the top plate 39 adjacent the rear plate 11.

Figure 10A:
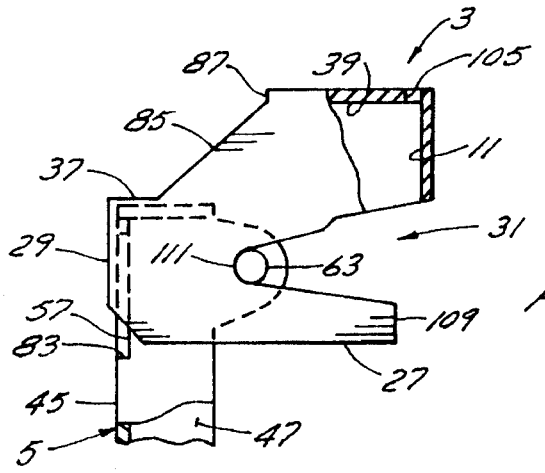
FIGS. 10A to 10D are detail views in partial cross-section with the table top in different positions during movement between stored and operative positions.

In use the base 3 is mounted on a vertical support, such as a balcony railing "R", with the aid of the backing member 17 and the bolts and nuts 21, 23. The base 3 is horizontal and its rear plate 11 is snug against the railing. The table top 5 is suspended from the base 3 by positioning the table top beneath the base in a vertical position with the hangers 61 at the top and by moving the table top upwardly and forwardly to pass the rods 63 of the hangers 61 upwardly past the free ends 109 of the arms 27, and then forwardly to locate the rods 63 in the front end 111 of the slots 31 as shown in FIG. 10A. As the table top 3 is being positioned the arms 27 and braces 29 loosely pass through the slot openings 81 in the table top. With the rods 63 at the front of the slots 31, the table top 3 hangs down from the arms 27, suspended by the rods 63 resting on the arms 27. The table top 3 lies closely adjacent to the balcony railing "R" in a vertical, stored position. Since the rods 63 are offset laterally from top sheet 45 and skirt 47, the weight of the table top 5 slants it inwardly from the support of the rods 63. This helps retain the table top 5 on the arms 27.

Figure 10B:
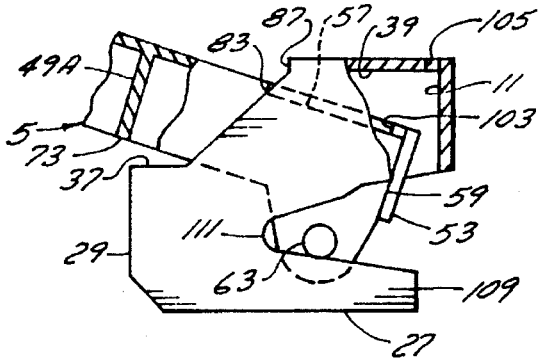
Figure 10C:
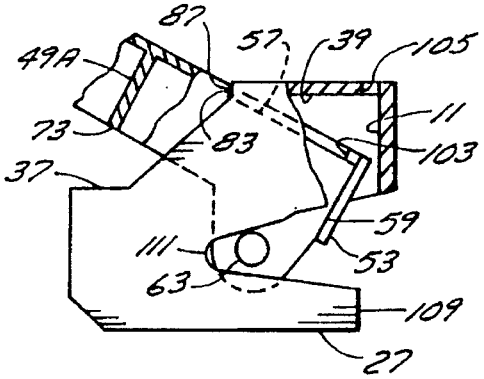
Figure 10D:
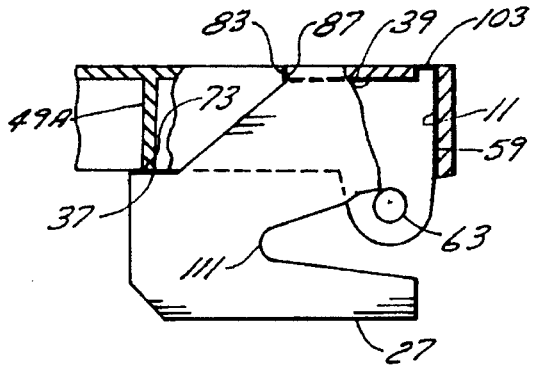

When it is desired to use the table, the table top 5 is pivoted forwardly and upwardly about the front end 111 of the slots 31 to a slightly above-horizontal position and then moved rearwardly. As the table top 5 is moved rearwardly, the ribs 93 enter the slots 97 to laterally position the table top 5. Also the front edge 83 of the depression 57, at the openings 81, slides upwardly along the cam surfaces 85 on the braces 29 guiding the rear portion of the table top 5 upwardly and rearwardly as shown in FIG. 10B. As the table top 5 moves rearwardly and upwardly the rods move rearwardly and upwardly in slots 31. When the front edge 83 of the depression 57 in the table top 5 hits the front edge of the top plate 39, as shown in FIG. 10C, the table top 5 is pivoted counterclockwise about edge 87 to seat the top plate 39 flush in the depression 57 and the back plate 11 flush in the recess 59 as shown in FIG. 10D. At the same time the stop surfaces 73 on the table top 5 slide onto the abutment surfaces 37 on the base 3 so that the table top 5 is securely locked between the top plate 39 and the abutment surfaces 37 in a horizontal, operative position. The tabs 103 on the table top 5 move into the openings 105 on the base 3 when the table top 5 is pivoted counterclockwise to retain the table top in its operative, horizontal position.

In the horizontal, operative position, since the back plate 11 of the base 3 fits flush into the recess 59 of the table top 5, the table top 5 is flush against the vertical support so there is no unsightly gap. The loose mounting of the hangers 61 on the arms 27 also permits the table top to be mounted flush against the vertical support since the hangers 61, and thus the table top 5, can move relative to the arms. The top plate 39 of the base 3 also fits flush into the depression 57 on the table top 5, covering the openings 81 and presenting a neat, clean working surface over the entire top surface area of the table top 5.

To store the table top 5 after use, it is merely pivoted upwardly slightly to drop the tabs 103 out of the openings 105, moved forwardly off the abutment surfaces 37 and then pivoted downwardly to its vertical stored position. As the table top 5 is moved forwardly, the rods 63 follow the upper wall 89 of the slots 31 to their front end 111.

Keeper means 119 can be provided to retain the hangers 61 on the arms 27. The keeper means 119 can comprise a bar 121 having projections 123 at each end that are sized to frictionally slide into openings 125 at the free ends 109 of the arms 27. The bar 121 is mounted on the arms 27 after the table top 5 is suspended from the arms 27 and before the base 3 is attached to the vertical support. When the base 3 is then attached to the vertical support the keeper bar 121 lies against the vertical support preventing its removal and retaining the hangers 61 on the arms 27. Since the keeper bar 121 is spaced below the back plate 11, it makes the mounting of the base 3 on the railing "R" more solid and stable.

Figure 7:
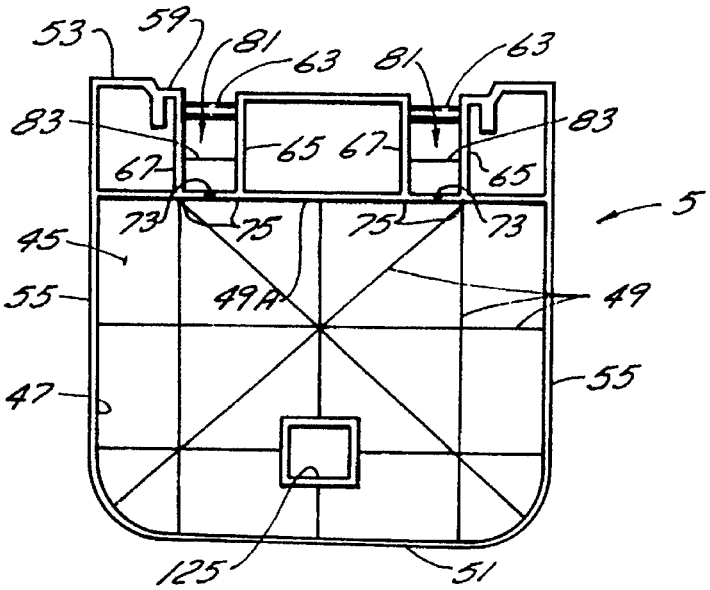
FIG. 7 is a bottom view of the table top.
Figure 9:
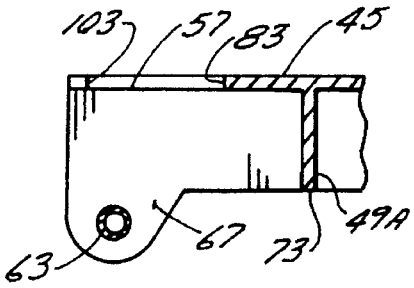
FIG. 9 is a cross-section view taken along line 9—9 in FIG. 8.
Figure 8:
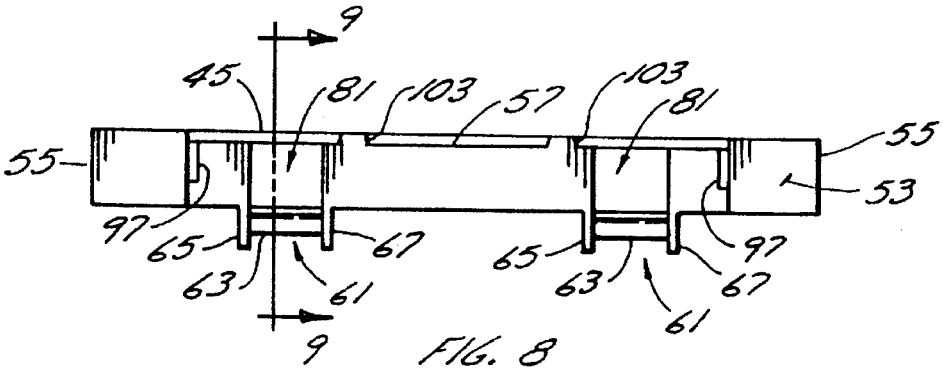
FIG. 8 is a rear view of the table top.

While it is contemplated that the table top can be supported from its inner end only in cantilever fashion, as described above, it is preferred that at least one table leg be employed to give the table top additional support in its operative position. To this end, a recess 125 is provided on the underside of the table top 5 close to its front 51 as shown in FIG. 7. The recess 125 is centered between the sides 55 of the table top 5. A table leg 7 is provided having a generally channel shaped cross-section. The top and bottom ends of the leg 7 are closed by top and bottom walls 129 and 131 as shown in FIG. 11. Spaced apart, u-shaped ribs 133 are provided within the leg 7. The ribs 133 are parallel to the top and bottom walls 129, 131 and are sized to frictionally receive one side 55 of the table top 5. When not in use the table leg 7 can be stored on one side 55 of the table top 5 when the table top is in its stored position. In use, the table leg 7 is slipped off the side 55 of the table top 5, and the top end of the table leg 7 is fitted snugly into the recess 125 to support the table top 5 in its operative, horizontal position. Preferably the bottom end of the leg is provided with an adjustment member 141. The adjustment member 141 can comprise a bottom plate 143 with a squat stem 145 extending up from the plate 143. Opposed sides of the stem 145 have vertically spaced apart grooves 147. The bottom wall 131 of the leg 7 is slotted as shown at 149. The sides 151 of the slot 149 slide into any of the grooves 147 in the stem 145. Thus the distance of the bottom plate 143 from the bottom wall 131 of the leg 7 can be adjusted to vary the overall length of the leg.

I claim:

1. A table having: a relatively narrow base; a relatively wide table top; the base having means for use in mounting the table against a vertical support; cooperating first support means on the base and on one end of the table top for vertically suspending the table top from the base in a storage position; the first support means having spaced-apart supports on the base extending transversely therefrom, and spaced-apart slots on the one end of the table top for receiving the supports with hanger rods in the slots for use in suspending the table top from the supports; cooperating second support means on the base and on the one end of the table top for supporting the table top in a horizontal operative position on the base, the second support means having a horizontal abutment surface on each support on the base and abutment means on the bottom of the table top at the one end cooperating with the abutment surfaces to help support the table top in the operative position.

2. A table as claimed in claim 1 wherein the first support means includes a horizontal arm on each support, each arm carrying one of the hanger rods when the table top is in the storage position.

3. A table as claimed in claim 2 wherein the second support means includes a top plate on the base, spaced above the horizontal abutment surfaces, the table top being held in the operative position between the top plate and the horizontal abutment surfaces on the support.

4. A table as claimed in claim 3 wherein the second support means includes a depression on the top surface of the table top at the one end, the top plate on the base fitting snugly into the depression when the table top is in the operative position.

5. A table as claimed in claim 1 including retaining means for retaining the table top to the base in the operative position to prevent horizontal movement of the table top on the supports.

6. A table as claimed in claim 1 including a table leg, means on the table leg for frictionally holding it onto a side of the table top when not in use.

7. A table as claimed in claim 1 including a table leg, and means on the bottom of the table top adjacent its other end for receiving one end of the leg to help support the table top in its operative position.

8. A table as claimed in claim 7 including a plate at the outer end of the leg and means for adjustably mounting the plate to the outer end of the leg to vary the length of the leg.

9. A table having: a relatively narrow base and a relatively wide table top; the base having a back plate for use in mounting the base and thus the table, against a vertical support; the table top having a top sheet and a skirt depending from the top sheet, the skirt forming a back wall for the table top; the table top mounted by its back end onto the base, when the base is mounted through its back plate on a vertical surface, for movement between a storage position, where the table top is suspended from the base, and an operative position where the table top extends horizontally from the base; the table having first cooperating support means on the base and the back end of the table top for suspending the table top from the base in the storage position; the first support means having a pair of spaced-apart supports extending transversely from the back plate of the base; a pair of spaced-apart slots in the back wall of the table top to receive the supports; and hanger rods on the table top extending across the slots and the supports to support the table top from the supports in the storage position.

10. A table as claimed in claim 9 including second cooperating support means on the base and the back end of the table for supporting the table top in a horizontal position from the base, the second support means having a horizontal abutment surface on each support and abutment means on the bottom of the table top at the back end cooperating with the abutment surfaces on the support to help support the table top in a horizontal position.

11. A table as claimed in claim 10 wherein the second support means has a top plate on the base above the horizontal abutment surfaces, the table top being held in the operative position between the top plate and the horizontal abutment surfaces on the supports.

12. A table as claimed in claim 11 wherein the second support means includes a depression on the top surface of the table top at the one end, the top plate on the base fitting snugly into the depression when the table top is in its horizontal, operative position.

13. A table as claimed in claim 10 including a table leg, means on the table leg for frictionally holding it onto a side of the table top when not in use.

14. A table as claimed in claim 10 including a table leg, and means on the bottom of the table top adjacent its front end for receiving one end of the leg to help support the table top in its operative position.

15. A table as claimed in claim 14 including a plate at the outer end of the leg and means for adjustably mounting the plate to the outer end of the leg to vary the length of the leg.

16. A table as claimed in claim 10 wherein the back wall of the table top lies adjacent and substantially parallel to the back plate of the base when the table top is in the operative position.

17. A table as claimed in claim 9 including a table leg, means on the table leg for frictionally holding it onto a side of the table top when not in use.

18. A table as claimed in claim 9 including a table leg, and means on the bottom of the table top adjacent its front end for receiving one end of the leg to help support the table top in its operative position.

19. A table as claimed in claim 18 including a plate at the outer end of the leg and means for adjustably mounting the plate to the outer end of the leg to vary the length of the leg.

20. A table as claimed in claim 9 wherein the back wall of the table top lies adjacent and substantially parallel to the back plate of the base when the table top is in the operative position.

* * * * *